US005195290A

United States Patent [19]

Hulett

[11] Patent Number: 5,195,290

[45] Date of Patent: Mar. 23, 1993

[54] LAMINAR ROOFING PRODUCT

[75] Inventor: John K. Hulett, Plymouth, Minn.

[73] Assignee: American Heartland Roofing Products, Inc., Plymouth, Minn.

[21] Appl. No.: 893,224

[22] Filed: Jun. 3, 1992

[51] Int. Cl.[5] ..... E04D 1/00

[52] U.S. Cl. ..... 52/518; 52/DIG.16

[58] Field of Search ..... 52/545, 315, 631, 528, 52/521

[56] References Cited

U.S. PATENT DOCUMENTS

| | | | |
|---|---|---|---|
| 4,141,187 | 2/1979 | Graves | 52/173 R |
| 4,226,069 | 10/1980 | Hinds | 52/528 X |
| 4,668,315 | 5/1987 | Brady et al. | 52/746 X |
| 4,860,509 | 8/1989 | Laaly et al. | 52/173 R |

*Primary Examiner*—David A. Scherbel
*Assistant Examiner*—Creighton Smith
*Attorney, Agent, or Firm*—Lawrence M. Nawrocki

[57] ABSTRACT

A roofing shingle. The shingle includes first, second, and third substrates. The first substrate includes a woven polyester mat, treated to make it fire-resistant and to keep it from stretching, embedded in an asphalt lamina.

12 Claims, 5 Drawing Sheets

LAMINAR ROOFING PRODUCT

TECHNICAL FIELD

The present invention relates broadly to the field of roofing coverings. More specifically, however, it is related to a composite shingle for use, particularly, in the covering of residential dwelling roofs. -The specific focus of the invention is the construction of the shingle such that it is more resistant to the elements and stronger to resist puncture.

BACKGROUND OF THE INVENTION

Numerous shingle products are known in the prior art. Most shingle products known have a number of goals. First and foremost of these goals is to preclude the elements from entering into the building (typically, a residential dwelling) with which the shingle is used. In furtherance of this objective, shingle manufacturers seek to make their products so they are resistant to hail, wind, and other aspects of the elements which might tend to deteriorate their products over the passage of time.

Another goal of shingle products is resistance to fire. The typical application for shingle products is in use in residential dwellings. Consequently, safety is an important consideration in the construction of a shingle product. It is desirable that a shingle be retardant to fire not only so that it does not, itself, burn, but also that it retards the spread of fire within the structure.

A third goal of all shingle products is that they be easy to apply. Included in this objective are the desires that the product be easy to handle, easy to position, and easy to mount.

The capstone goal of a shingle product is that it be aesthetically pleasing. Because of the particular application of shingle products in the residential dwelling market, purchasers frequently look to the aesthetics of the product in ultimately deciding on a particular product they wish to use.

It is to these dictates and problems of the prior art that the present invention is directed. It is an improved roofing shingle product which serves to solve numerous problems of the prior art without sacrificing desirable characteristics already afforded by prior art structures.

SUMMARY OF THE INVENTION

The present invention is a roofing shingle which includes a plurality of substrates. A first substrate includes a foundational lamina which has a woven polyester mat to give the overall product form and strength. A second substrate which, typically, comprises an asphalt material, overlies, and is adhered to, the first substrate. Finally, a third substrate overlies, and is adhered to the second substrate. The third substrate comprises a treated weather surface which not only serves a protective function, but also makes the shingle aesthetically pleasing.

In a preferred embodiment of the invention, the woven polyester mat is chemically treated. One chemical treatment includes impregnating the mat with a fire retardant material. Such a treatment would render the polyester mat, frequently in Class C on the scale of fire retardency, in Class A, the highest level on the scale.

The preferred embodiment also contemplates impregnation of the woven polyester mat with a stabilizer material. Such material effects resistance to stretching of the mat. As a result, the overall shingle product is afforded with a uniform, stable size and shape.

It is envisioned that the polyester mat would be embedded in a lamina of asphalt material. The woven polyester mat and the lamina of asphalt material in which it is embedded, therefore, together comprise the first substrate of the composite shingle in accordance with the present invention.

The second substrate, typically, comprises a layer of asphalt, overlying the first substrate. The third substrate weather surface can comprise particulate mineral granules. These granules can be ceramic in nature, and can be embedded on the second substrate asphalt material medium.

If desired, a sealant can be applied over the weather surface of the shingle. That is, a sealant can be applied over the ceramic mineral granule third substrate. Such a sealant is, typically, adhesive in nature, and can take the form of a modified asphalt.

In order to facilitate the provision of a new roof to a residential dwelling, for example, the undersurface of each composite shingle constructed as described can be provided with a liner release sheet. Consequently, when a plurality of the composite shingles are packaged together with one overlying the next, each individual unit can be easily separated from the others.

To facilitate mounting of the composite shingles to a roof surface, indicia can be provided to represent locations at which nails are to be pounded through the shingle. Such indicia can comprise spots, at appropriate locations on the weather surface of the shingle, representative of intended nail locations.

The present invention is thus an improved composite shingle product which solves many of the problems of the prior art. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
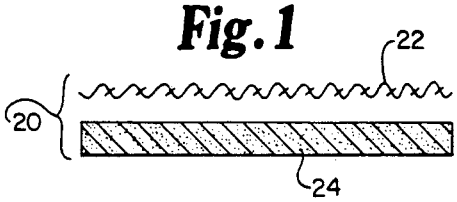
FIG. 1 is a sectional view of a first substrate of the shingle showing an asphalt lamina and a woven polyester mat.
Figure 2:
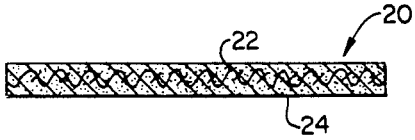
FIG. 2 is a sectional view, similar to FIG. 1, showing the polyester mat embedded in the asphalt lamina.

Referring now to the drawings wherein like reference numerals denote like elements throughout the several views, FIGS. 1 and 2 illustrate a first substrate 20 of a composite roofing shingle product in accordance with the present invention. FIG. 1 illustrates that substrate 20 with a woven polyester mat 22 separated from an asphalt material carrier lamina 24 in which the polyester mat 22 can be embedded. FIG. 2 illustrates a first substrate 20 with the polyester mat 22 already embedded in the asphalt material lamina 24. It will be understood that the mat can be embedded in the lamina 24 in any appropriate manner and that the specific manner in which the lamina 24 receives the polyester mat 22 is not part of the invention.

Figure 3:
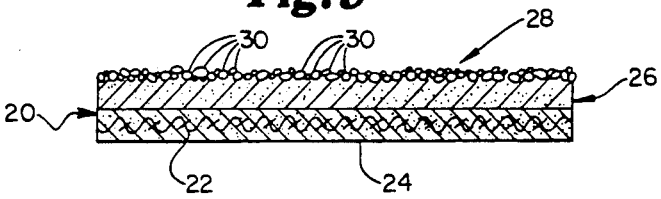
FIG. 3 is a sectional view similar to FIGS. 1 and 2 showing second and third substrates formed integrally with the first substrate.

The polyester mat 22 utilized is of a type known, in isolation, in the art. A number of appropriate woven mat materials are made by Hoechst Celanese Corporation. These include a number of fabrics identified as Trevira Spunbond Polyester Mat Base Type 32 including, specifically, fabrics 3214, 3218, and 3225. These specific fabrics provide adequate strength in multiple directions and resistance to tearing and puncture in order to accomplish the objectives intended to be achieved by a composite roofing shingle structure in accordance with the present invention. FIG. 3 illustrates a second substrate 26 overlying, and adhered to, the first substrate 20, and, further, a third substrate 28 overlying, and adhered to the second substrate 26. The three substrates 20, 26, 28 are thus bonded together to form a unitary construction.

The second substrate 26 is a coating which immediately overlies the base or mat substrate 20. The coating, typically, comprises an asphalt material similar to the lamina material which the first substrate 20 includes. It will be understood by one of skill in the art that these two laminae 20, 26 can be easily bonded together by applying heat and/or pressure to effectively meld the laminae together.

The third substrate 28, as previously discussed, overlies, and is adhered to, the second substrate 26. The third substrate 28 comprises a weather surface which, when the shingle product in accordance with the present invention is mounted to the roof of a building (for example, a residential dwelling), is exposed to the elements. Typically, the third substrate 28 comprises particulate granules 30 which are embedded in the asphalt material of the second substrate 26. In a preferred embodiment, the particulate granules 30 which would be employed would be mineral granules of a ceramic material.

If appropriate and desired, a sealant material can be employed to cover the weather surface (that is, the particulate ceramic material granules) of the third substrate 28. In the preferred embodiment, the sealant takes the form of a modified asphalt which has a rubber byproduct mixed therein. Potential suppliers of such a sealant are Sika Corporation and Shell Chemical Company.

As discussed in this document, it is optimum for the woven polyester mat 22 and, in fact, all components of the composite shingle product) to be fire retardant in nature. Since polyester fiber mats as discussed hereinbefore tend to have a Class C rating when they are untreated, treatment can be accomplished by employment of a fire retardant agent to impregnate the mat. An appropriate dry chemical fire retardant agent is manufactured by the 3M Corporation of St. Paul, Minnesota and the Shell Chemical Company of Houston, Texas. By impregnating the polyester mat with such an agent, the mat can achieve a Class A rating. Safety standards can, thereby, be achieved.

As previously discussed, woven polyester mats as indicated have high resistance to puncture and tears. In an untreated state, however, they can be subject to deformation because of fiber shiftings. It can be desirable, therefore, to treat the mat 22 with a stabilizing agent. Such an agent can effect bonding of the fibers so that fiber shifts will be inhibited and a more stable and uniformly sized and shaped mat (and, consequently, a composite shingle product employing the mat) can be provided. Any appropriate stabilizing agent known in the prior art can be employed to accomplish this goal.

As previously discussed, the asphalt material employed in both the first and second substrates 20, 26 can be the same medium. A particular asphalt material that has been found acceptable for use in the present invention is one containing Kraton G (SEBS) Copolymers. Such a product is manufactured by Shell Chemical Company.

Figure 4:
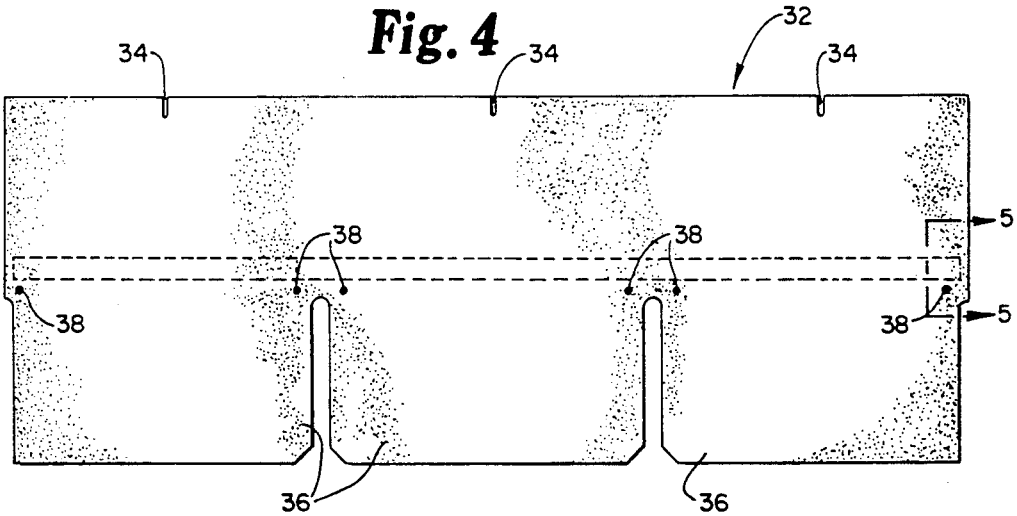
FIG. 4 is a top plan view of a specific configuration of a shingle made in accordance with the present invention.
Figure 5:
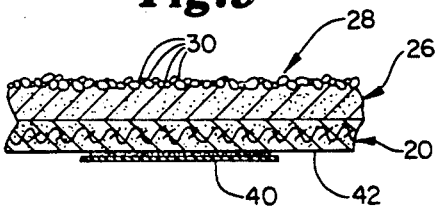
FIG. 5 is a sectional view taken generally along line 5—5 of FIG. 4, an adhesive and liner being illustrated.

FIGS. 4 and 5 illustrate a particular shingle product 32 manufactured employing the three-substrate construction in accordance with the present invention. The particular product 32 illustrated is shown as having a plurality of roofing location slits 34 as known in the prior art. A number of tab portions 36 extend downwardly and simulate separate shingles. FIG. 4 illustrates indicia 38, located on the weather surface of the shingle product 32, to identify locations at which nails are to be pounded through the shingle 32 to mount the shingle to a roof. It will be understood that these indicia 38 could be provided in any appropriate manner. Spots could be colored onto the weather surface, or indentations could be provided in that surface.

FIG. 5 illustrates employment of a liner 40 applied to a tacky underside 42 of the first substrate 20. Such a liner 40 can function to insulate one shingle unit 32 from immediately adjacent shingle units in the same package. Individual shingles are, thereby, more accessible to the installer. It will be understood that this liner 40 need not be removed prior to installation of the shingle unit, although removal could be accomplished if desired.

Figure 6:
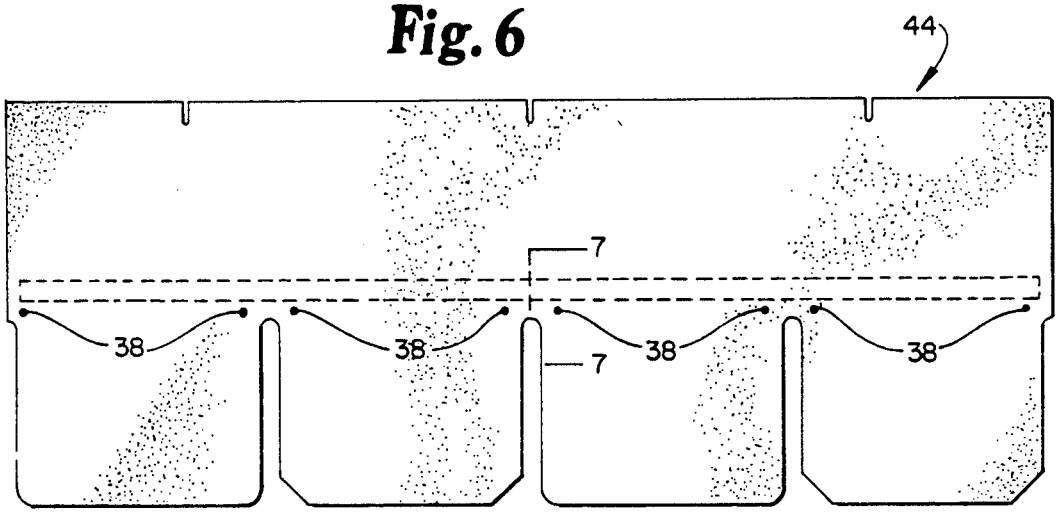
FIG. 6 is a top plan view, similar to FIG. 4, showing a second shingle product.
Figure 8:
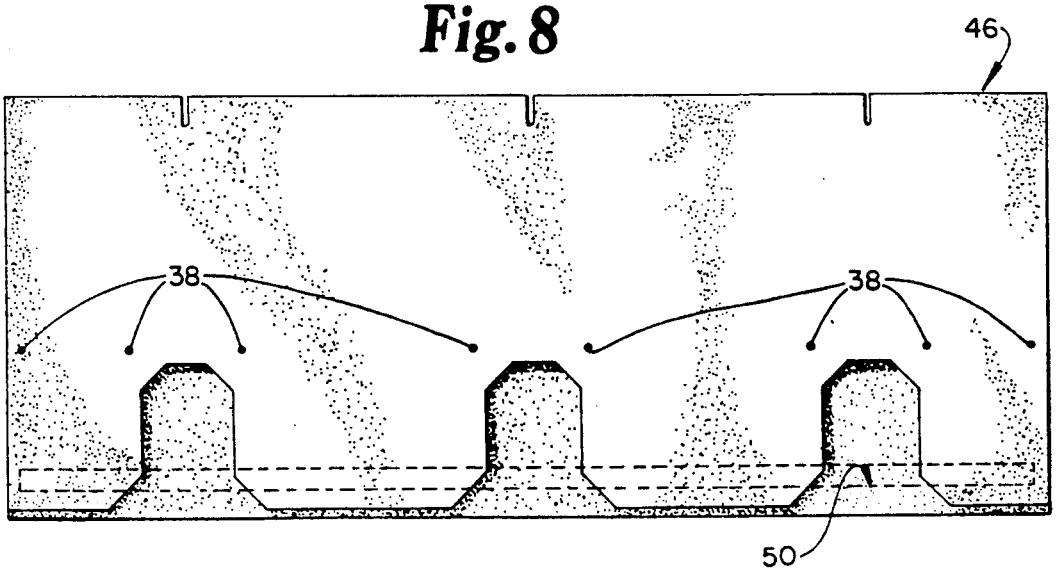
FIG. 8 is a top plan view, similar to FIG. 6, showing another shingle product.

FIGS. 6 and 8 illustrate two-ply shingle products 44, 46. If desired for aesthetic reasons, a bottom ply 48, 50 can employ darker colored mineral granules to lend contrast to the product. A more appealing appearance is, thereby, provided.

Figure 7:
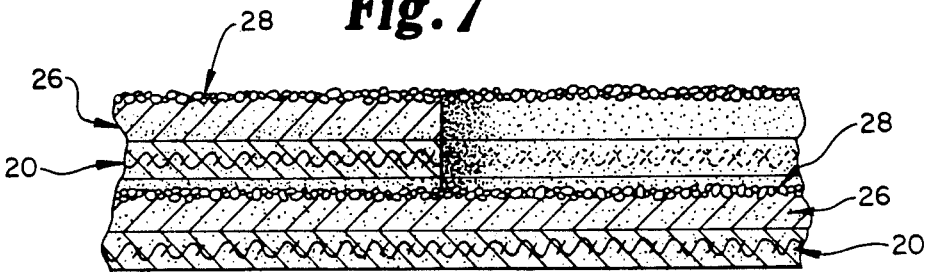
FIG. 7 is a sectional view taken generally along line 7—7 of FIG. 6.

FIG. 7 shows a cross-section of the product illustrated in FIG. 6. As can be seen in FIG. 7, each ply has a construction substantially the same as the cross-sectional construction of the product illustrated in FIG. 4. That is, each ply has a three-substrate laminar structure.

Figure 10:
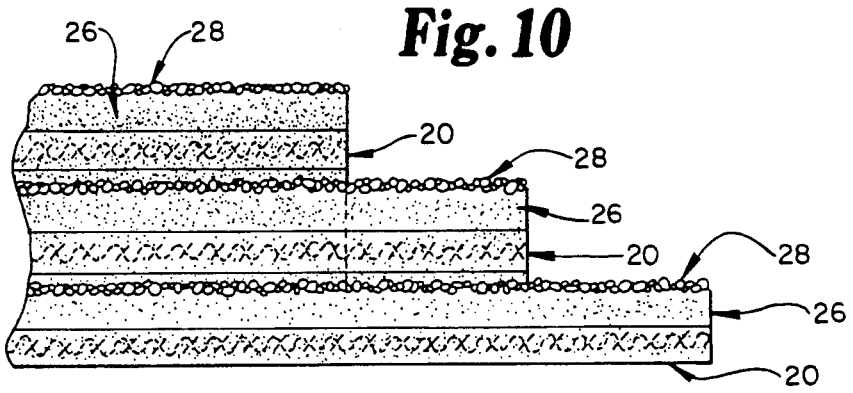
FIG. 10 is a sectional view taken generally along line 10—10 of FIG. 9.
Figure 9:
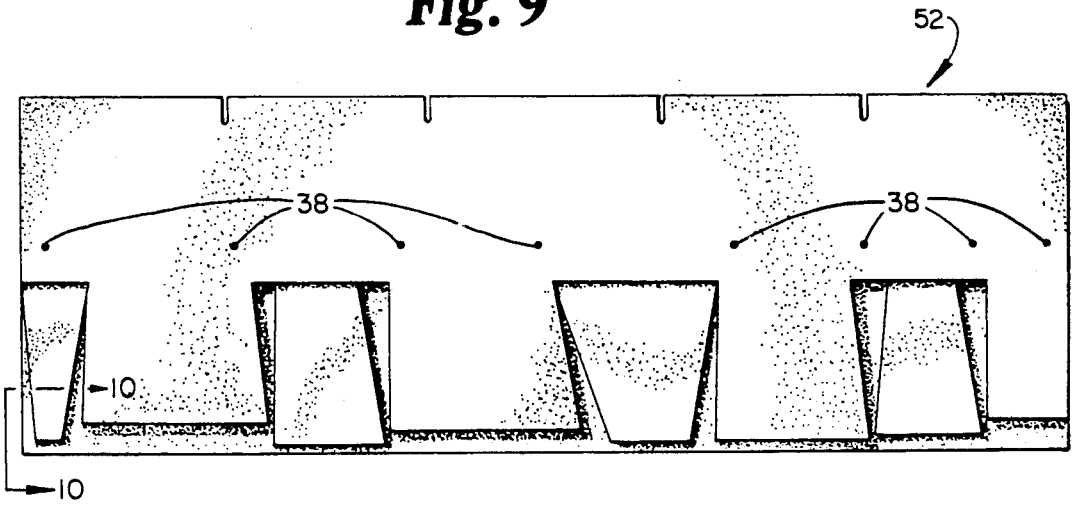
FIG. 9 is a top plan view showing another shingle product.
Figure 11:
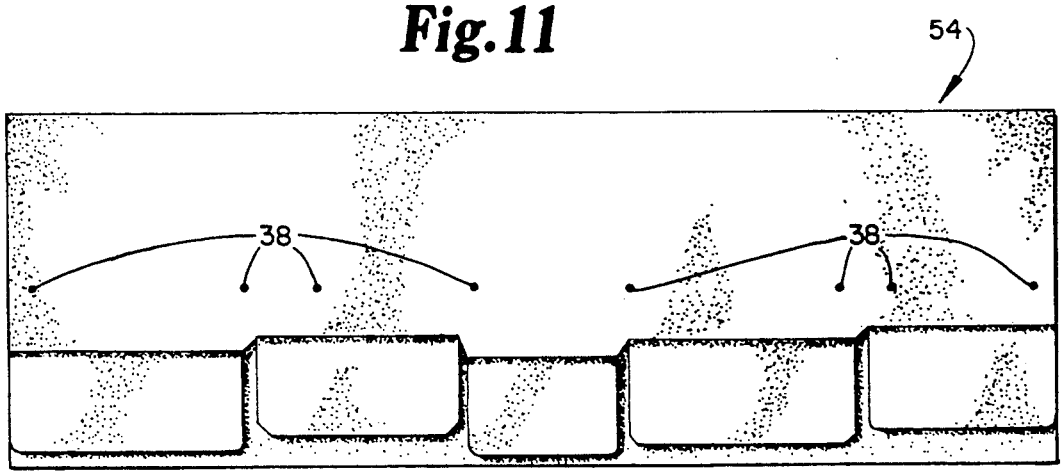
FIG. 11 is a top plan view, similar to FIG. 9, showing another shingle product employing the present invention.

FIGS. 9 and 11 illustrate three-ply shingle products 52, 54. FIG. 10 illustrates a typical cross-section of those products. As can be seen, each ply is provided with a three-substrate configuration, that configuration being the same as those for the shingle products illustrated in FIGS. 4, 6, and 8. The plies are bonded together in an appropriate manner.

Figure 13:
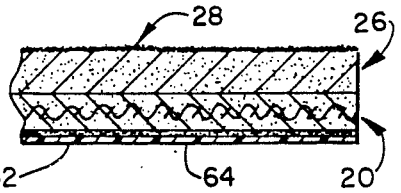
FIG. 13 is a sectional view taken generally along line 13—13 of FIG. 12.
Figure 12:
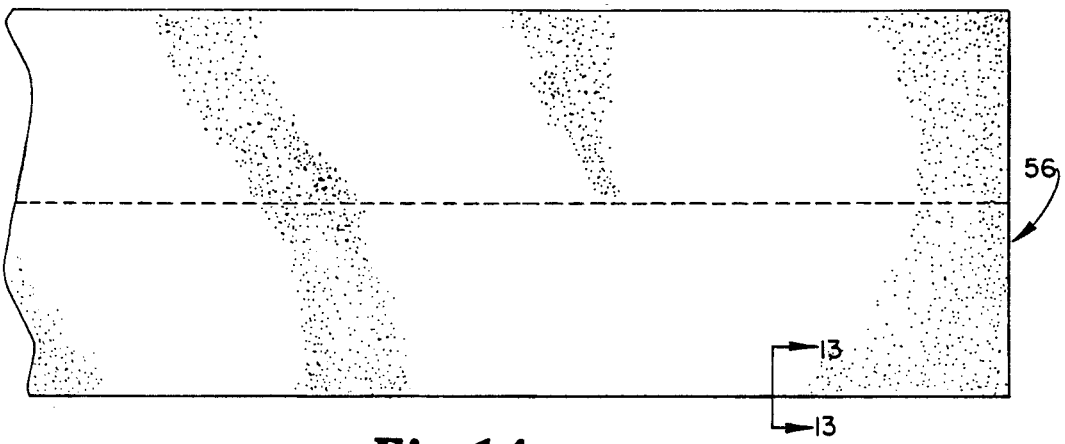
FIG. 12 is a top plan view showing a configuration of a roofing roll alternative embodiment.
Figure 14:
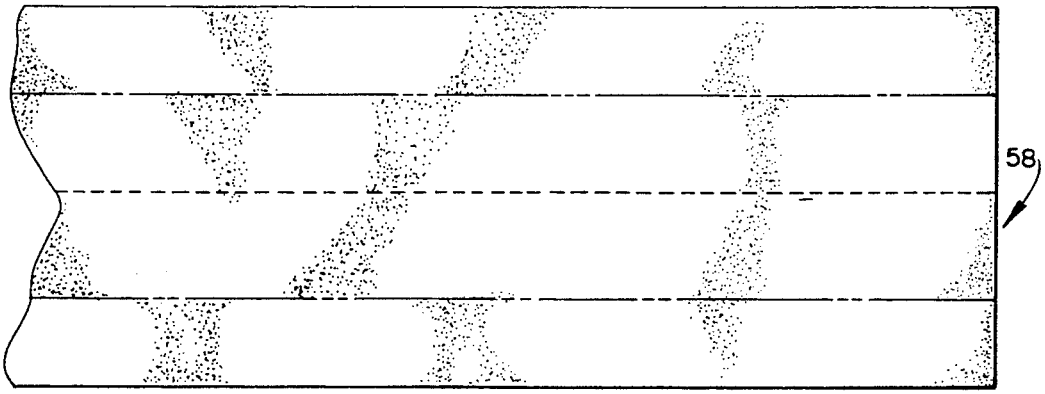
FIG. 14 is a top plan view showing a further alternative configuration of a roofing roll.
Figure 15:
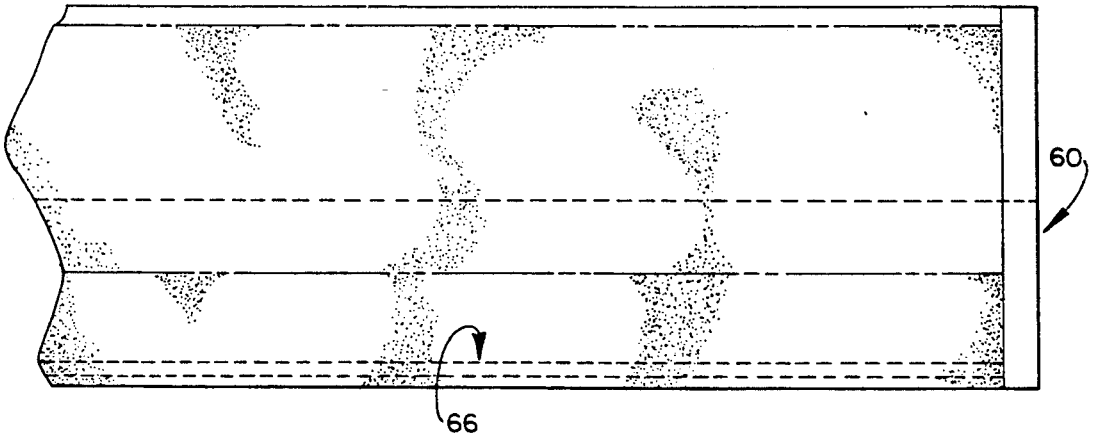
FIG. 15 is a top plan view showing another alternative configuration of a roofing roll.

FIGS. 12, 14, and 15 illustrate three special applications of roofing roll embodiments 56, 58, 60. FIG. 13 illustrates an enlarged cross-sectional portrayal of the embodiment of FIG. 12. As will be seen with reference to FIG. 13, the cross-section of the embodiment of FIG. 12 is substantially the same as the cross-sections of embodiments previously described herein. FIG. 13, however, shows an adhesive 62 as specifically being provided on an underside of the first substrate. Such an adhesive 62 enables quick and facile positioning of a length of the material, as shown in FIG. 12, from a roll.

FIG. 13 also illustrates a release film 64 as overlying the adhesive layer 62 The product 56 illustrated in FIG. 12 being provided in a roll configuration, a coil of the product in engagement with a immediately adjacent coil could become adhered to that coil if the release film were not provided. Prior to application for the intended purpose, the release film 64 merely need be withdrawn from the adhesive 62 in order to expose the adhesive 62 for application.

It will be understood that the cross-sections of the embodiments of FIGS. 14 and 15 are substantially the same as that of the embodiment of FIG. 12. The embodiments of FIGS. 14 and 15 are also intended to have an adhesive and an overlying release film.

The third substrate (that is, the weather surface) varies depending upon the specific application of the embodiment. For example, one embodiment (the one illustrated in FIG. 12) would have sand granules embedded in the asphalt material of the second substrate. Such an embodiment would, typically, be used where no part of the weather surface were intended to be exposed to view.

The embodiments of FIGS. 14 and 15 have some portion of the weather surface formed by the embedding of ceramic mineral granules in the asphalt material of the second substrate. Other portions, however, employ sand embedded in the asphalt material of the second substrate.

It is intended that exposed areas would be covered with ceramic mineral granules, while non-exposed areas would be covered by sand granules. The embodiment illustrated in FIG. 14 has sand granules extending along the lateral portions of the roll material and ceramic mineral granules extending along the medial portion of the roll material. FIG. 15 shows a roll material construction wherein sand is embedded in the asphalt material along much of the weather surface, only a small marginal portion at the lower edge of the roll, as at 66, having ceramic mineral granules embedded therein.

Figure 16:
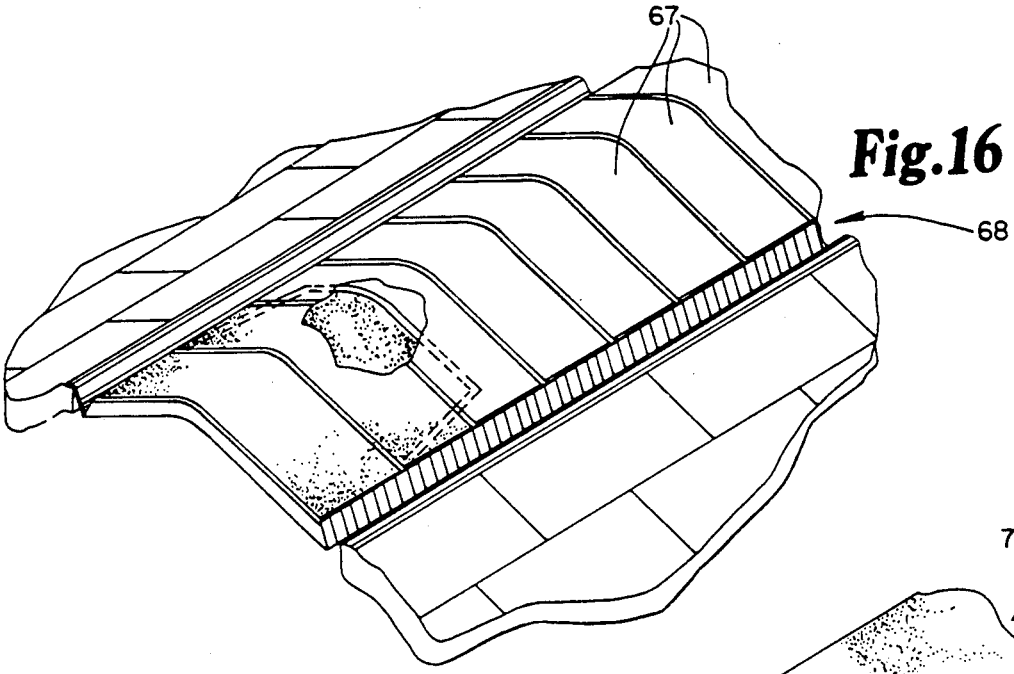
FIG. 16 is a fragmentary perspective view showing a cap shingle embodiment illustrated on a roof peak.
Figure 17:
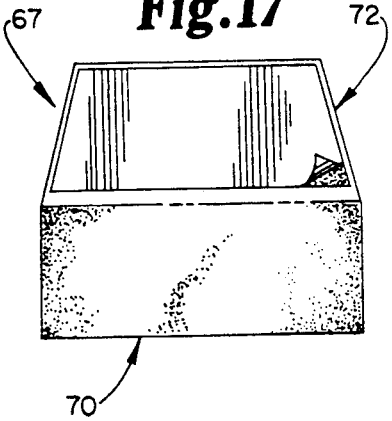
FIG. 17 is a top plan view thereof.

FIGS. 17 and 16, respectively, illustrate an embodiment of a roofing shingle 67 having the laminar structure as previously discussed, and a roof peak ventilation system area 68 to which such shingles are to be applied. As seen in FIG. 17, a generally rectangular portion 70 of the shingle product 67 illustrated therein has a third substrate that is formed by embedding ceramic mineral granules in the second substrate asphalt material. A trapezoidal portion 72 of the product 67, however, has no granular materials whatsoever. Rather, the trapezoidal portion 72 is intended to effect adherence of the product 67 to the substructure to which it is to be attached to facilitate the securing of an overlapping product unit in an attached relationship. It will be understood that only the rectangular portion 70 of the ceramic mineral granules embedded therein would be exposed to view once the product 67 is in place.

Figure 18:
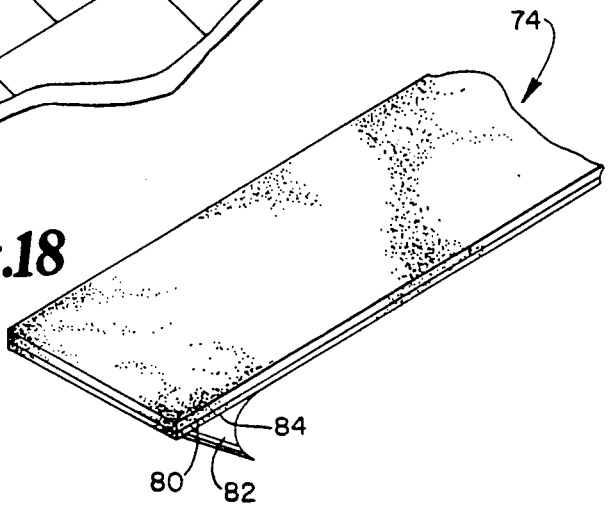
FIG. 18 is a perspective view showing a cap selection alternative embodiment.
Figure 19:
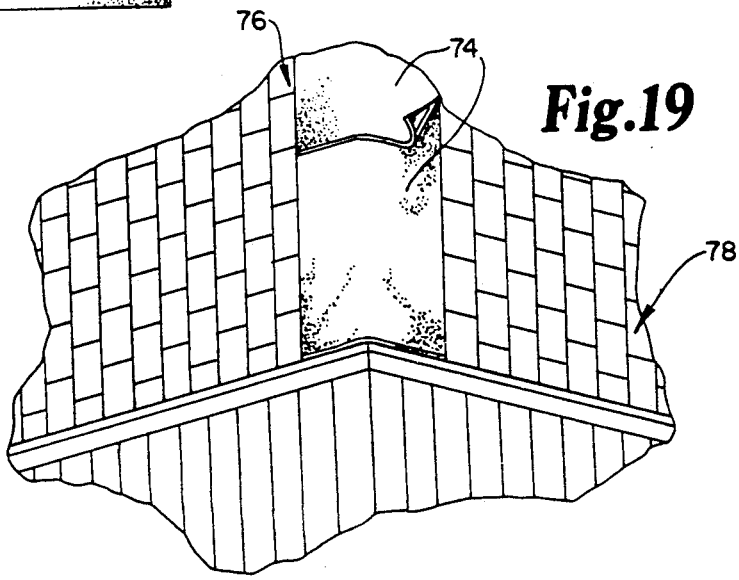
FIG. 19 is a fragmentary perspective view thereof shown on a roof peak.

FIGS. 18 and 19, respectively, show another embodiment of a roofing shingle product 74 in accordance with the present invention and its manner of application at a cap section 76 of a roof 78. The product is shown as having a third substrate which is completely embedded with ceramic mineral granules. Substantially the full upper surface of the product is exposed to view. A small segment of one unit, however, overlaps with a small portion of the immediately adjacent segment. The units which are, thereby, aligned extend the crest of the roof and straddle the crest with approximately half of the width of the each unit on either side of the crest.

As best seen in FIG. 18, the underside of the first substrate of the product illustrated therein is provided with an adhesive 80, and such an adhesive 80 facilitates maintenance of the product unit in the intended position. A peel-off release film 82 is shown as normally being in place overlying the adhesive 80 so as to protect the tacky surface 84. Again, the release film 82 can be withdrawn immediately prior to application.

As in the case of the roll products illustrated in FIGS. 12, 14, and 15, the cross-sections of the products illustrated in FIGS. 17 and 18 are substantially the same as the cross-sections of the other products disclosed herein. They therefore are afforded with the laudatory advantages of being provided with a first substrate having a woven polyester mat therein.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A continuous roll shingle product, comprising:

(a) a first substrate including a woven polyester mat;

(b) a second substrate, overlying and adhered to said first substrate, including an asphalt material;

(c) a third substrate, overlying and adhered to said second substrate, including a weather surface; and (d) an adhesive applied to an undersurface of said first substrate.

2. A product in accordance with claim 1 further comprising a release film underlying said adhesive;

wherein, as said product is rolled up, adjacent coils will not adhere to one another.

3. A product in accordance with claim 1 wherein said weather surface comprises sand granules embedded in said asphalt material.

4. A product in accordance with claim 1 wherein said woven polyester mat is impregnated with a first-retardant agent.

5. A product in accordance with claim 4 wherein said woven polyester mat is impregnated with a stabilizing agent to retard stretching of said mat.

6. A product in accordance with claim 1 further comprising a sealant covering said weather surface.

7. A product in accordance with claim 6 wherein said sealant comprises a rubber by-product modified asphalt material.

8. A roofing shingle, comprising:

(a) a first substrate including a woven polyester mat;

(b) a second substrate, overlying and adhered to said first substrate, including an asphalt material;

(c) a third substrate, overlying and adhered to said second substrate, including a weather surface; said weather surface comprising particulate granules, made of a ceramic material, embedded in said asphalt material.

9. A roofing shingle, comprising:

(a) a first substrate including a woven polyester mat;

(b) a second substrate, overlying and adhered to said first substrate, including an asphalt material;

(c) a third substrate, overlying and adhered to said second substrate, including a weather surface; and (d) a sealant covering said weather surface, said sealant comprising a rubber by-product modified asphalt material.

10. A roofing shingle, comprising:

(a) a first substrate including a woven polyester mat, said woven polyester mat being impregnated with a fire-retardant agent;

(b) a second substrate, overlying and adhered to said first substrate, including an asphalt material; and (c) a third substrate, overlying and adhered to said second substrate, including a weather surface.

11. A shingle in accordance with claim 10 wherein said woven polyester mat is impregnated with a stabilizing agent to retard stretching of said mat.

12. A roofing shingle, comprising:

(a) a first substrate including a woven polyester mat;

(b) a second substrate, overlying and adhered to said first substrate, including an asphalt material;

(c) a third substrate, overlying and adhered to said second substrate, including a weather surface; and (d) a liner applied to an underside of said first substrate to preclude sticking of one shingle to another when a plurality of said shingles are enclosed in packaging.

* * * * *